US006158186A

United States Patent [19]

Feller

[11] Patent Number: 6,158,186

[45] Date of Patent: Dec. 12, 2000

[54] CEILING ARRANGEMENT FOR CLEAN ROOMS

[75] Inventor: Eugen Feller, Grafenau, Germany

[73] Assignee: M & W Zander Facility Engineering GmbH, Germany

[21] Appl. No.: 09/239,507

[22] Filed: Jan. 28, 1999

[30] Foreign Application Priority Data

Jan. 28, 1998 [DE] Germany ..... 198 03 080

[51] Int. Cl.[7] ..... E04B 9/00

[52] U.S. Cl. ..... 52/506.06; 52/506.05; 52/506.07; 52/506.09

[58] Field of Search ..... 52/506.06, 506.05, 52/506.09, 506.07, 506.08, 726.2; 454/187

[56] References Cited

U.S. PATENT DOCUMENTS 4,570,408 2/1986 Frascaroli et al. ..... 52/726.2
4,944,129 7/1990 Hartleif ..... 52/506.08
5,207,035 5/1993 Fowler ..... 52/506.06 X
5,469,681 11/1995 Wu ..... 52/506.09 X
5,687,527 11/1997 Bikard et al. ..... 52/506.06 X

*Primary Examiner*—Beth A. Stephan
*Assistant Examiner*—Brian E. Glessner
*Attorney, Agent, or Firm*—Robert W. Becker & Associates

[57] ABSTRACT

A ceiling arrangement for clean rooms has profiled beams with end faces and connecting members having at least two end faces that are connectors for the end faces of the profiled beams. The end faces of the profiled beams are connected to the connectors of the connecting members to form a flush connection. A sealing member for sealing each one of the flush connections is provided. For each one of the flush connections the end face of the connecting member or the end face of the profiled beam has a groove in which the sealing member is received.

15 Claims, 1 Drawing Sheet

CEILING ARRANGEMENT FOR CLEAN ROOMS

BACKGROUND OF THE INVENTION

The present invention relates to a ceiling arrangement for clean rooms comprising profiled beams which are connected to one another by connecting members having at least two connecting sides, wherein the end faces of the profiled beams are positioned flush and sealingly at the end faces of the connecting sides.

Such ceiling arrangements are used for securing and supporting filter/ventilation units in clean rooms. The ceiling arrangement is comprised of profiled beams and connecting members connecting them to one another. The resulting ceiling openings are used to insert therein the filter/ventilation units that are supported on the ceiling arrangement. The area above the ceiling arrangement must be sealed relative to the clean room below the ceiling arrangement. For this purpose, the flush abutment area between the profiled beams and the connecting members are sealed by a liquid sealing material after mounting the ceiling arrangement. For this purpose, the ceiling arrangement is provided with fill openings through which the sealing liquid is introduced. This results in the problem that it is impossible to visually detect whether the sealing liquid has been distributed sufficiently in order to ensure reliable sealing action.

It is therefore an object of the present invention to embody the ceiling arrangement of the aforementioned kind such that in the abutment area between the profiled beams and the connecting members a reliable sealing action is ensured.

SUMMARY OF THE INVENTION

This object is inventively solved in that in the abutment area between the profiled beam and the connecting member a groove is provided in which a dry (solid) sealing member is positioned.

Accordingly, in the inventive ceiling arrangement, the abutment area between the profiled beams and the connecting sides of the connecting members, a dry sealing member is used which before assembly of the profiled beams and the connecting members can be inserted into the matching grooves. It is then easily possible to determine whether the dry sealing member has been properly inserted. Accordingly, after assembly of the profiled beams and the connecting members a reliable sealing action in the abutment area is ensured. Furthermore, in the case of a repair, a renewed sealing action is very simple to achieve. For example, when one of the profiled beams can be removed in order to exchange the filter/ventilation unit and/or repair it. Afterward, into the open groove the old sealing member or a new dry sealing member can be inserted without problems so that, after reassembly of the profiled beam, again a reliable sealing action in the abutment area is ensured.

BRIEF DESCRIPTION OF THE DRAWINGS

The object and advantages of the present invention will appear more clearly from the following specification in conjunction with accompanying drawings, in which.

DESCRIPTION OF PREFERRED EMBODIMENTS

The present invention will now be described in detail with the aid of several specific embodiments utilizing FIGS. 1–4.

Figure 1:
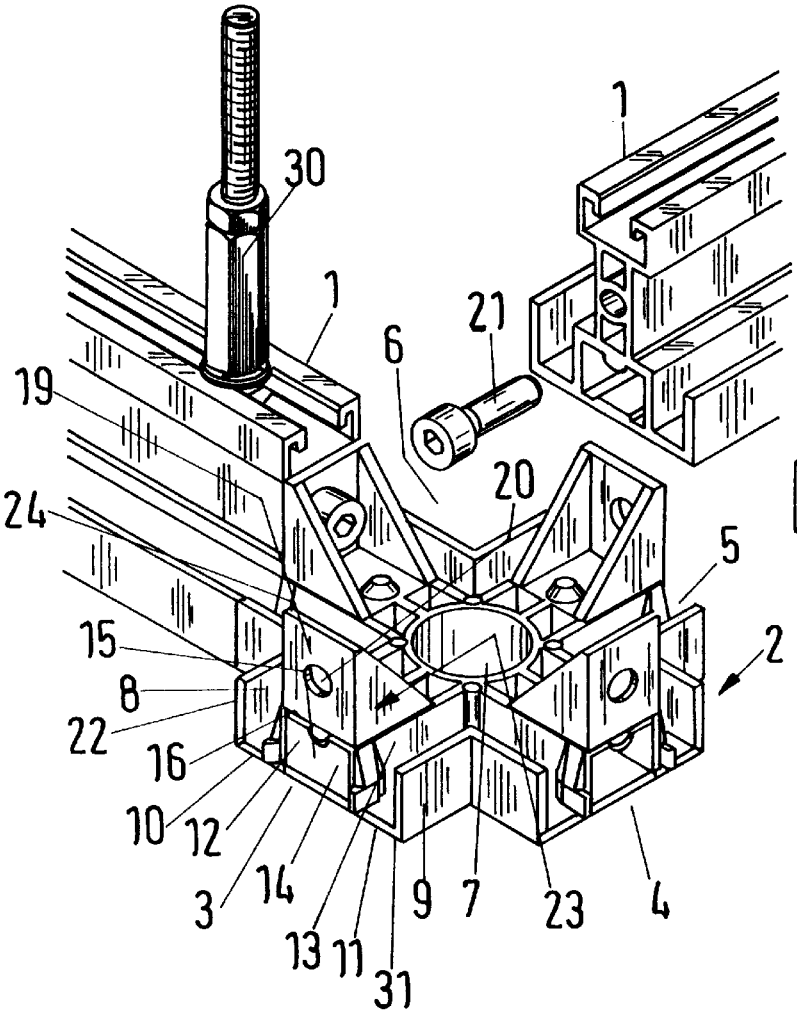
FIG. 1 is a perspective representation of a connecting point of the inventive ceiling arrangement for clean rooms.

The ceiling arrangement is designed to receive and support filter/ventilation units for clean rooms. The ceiling arrangement is comprised of profiled beams 1 and connecting members 2 which are connected to one another in a manner known to a person skilled in the art. In FIG. 1, the connecting member 2 is shown as a cross-shaped point to which four perpendicularly arranged profiled beams 1 are to be connected at the respective end faces. In the corner areas of the ceiling arrangement, angled or L-shaped connecting members are provided to which two profiled beams 1 positioned at an angle, preferably at a right angle, are to be connected to one another. Along the edges of the ceiling arrangement, T-shaped connecting members 2 are used to which three profiled beams positioned at an angle, preferably at a right angle, are to be connected. Conventionally, the profiled beams 1 are positioned at a right angle to one another so that the connecting members 2 have respective connectors positioned at a right angle to one another.

The connecting member 2 connecting a cross point has two connectors 3–6 positioned at a right angle to one another which are of identical design. Accordingly, in the following only one of the connectors 3 is to be described in detail. This connector is embodied as a hollow profiled member projecting transversely from a base body 7 of the connecting member 2. The connector 3 has two parallel sidewalls 8 and 9 which at their lower edge are connected by perpendicularly extending bottom walls 10, 11 to parallel extending inner sidewalls 12 and 13. The sidewalls 8, 9, 12, 13 have the same height. The inner sidewalls 12,13 delimit together with a bottom 14, extending perpendicularly thereto, a hollow space 15 which is closed off by a cover wall 16. This cover wall 16 extends parallel to the bottom 14 and connects the side walls 12, 13 at their upper longitudinal edge. The bottom 14 of the hollow space 15 connects the lower longitudinal edges of the sidewalls 12, 13 and is positioned in the same plane as the bottom walls 10, 11. The bottom walls 10, 11, 14 are planar and, when in the assembled position, form a portion of the underside of the connecting member 2.

The sidewalls 8, 12 and the bottom wall 10 as well as the sidewalls 9, 13 and the bottom 11 delimit each respectively a trough 17 and 18 which receive a sealing material. The troughs 17, 18 are open in the upward direction and are connected at a right angle to the neighboring troughs of the neighboring connectors 4, respectively, 6.

A wall 19 is positioned perpendicularly on the cover wall 16 and is provided with a through opening 20 for a threaded bolt 21. The outer side of the wall 19 is positioned in a common plane with the end face 22 of the connector 3. To the back side of the wall 19 two sidewalls 23 and 24 are connected which are also positioned perpendicularly to the cover wall 16 and, in an end view, are triangular. The sidewalls 23, 24 taper from the connecting side 3 upwardly to the upper edge of the wall 19.

The profiled beams 1 to be connected to the connectors 3–6 in a flush manner, have a profiled piece 25 which has substantially the same contour as the connector 3. Accordingly, the profiled element 25 when the profiled beam 1 is mounted, provides a substantially continuous connection to the connector 3. A stay 26 is connected to the profiled element 25 which stay is embodied as a hollow profiled member and is arranged on edge. At half the height of the stay 26 a transverse stay 27 is provided which has a centrally arranged opening 28 penetrating through its entire length. At the side of the stay 26 facing away from the profiled element 25 a C-shaped beam portion 29 is provided which is designed for receiving securing elements 30 with which the ceiling arrangement is to be suspended from a ceiling. The profiled beams 1 are preferably of a unitary construction. Furthermore, the connecting member 2 is also preferably of a unitary (single piece) construction.

For producing the ceiling arrangement, the profiled beams 1 are placed in abutment at the respective connectors 3–6. With the aid of the threaded bolts 21 the profiled beams are then fixedly connected to the corresponding connecting members 2. The threaded bolts 2 are inserted into the through openings 20 and are then threaded into the openings 28 in the transverse state 27 of the profiled beam 1. The bolt head is protected in the area between the two triangular sidewalls 23, 24. The stay 26 is in flush abutment at the outer side of the wall 19. The profiled element 25 is also positioned with its planar end face at the corresponding planar end face 22 of the respective connectors 3–6 of the connecting member 2.

Figure 2:
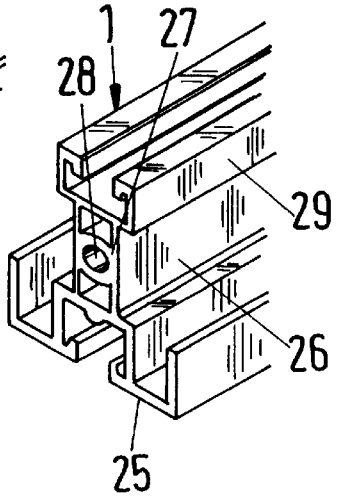
FIG. 2 shows an end view of a dry sealing member of the inventive ceiling arrangement.
Figure 3:
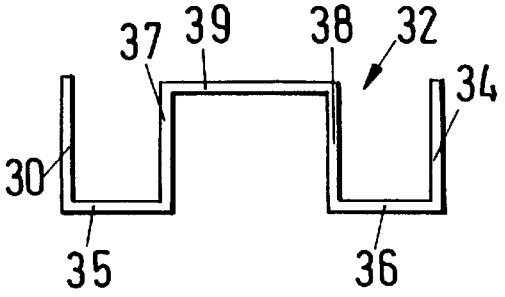
FIG. 3 shows a plan view onto the dry (solid) sealing member according to FIG. 2.
Figure 4:
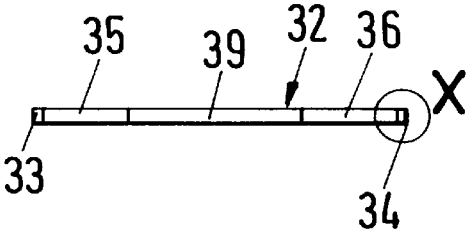
FIG. 4 shows an enlarged representation of the detail X of FIG. 3
Figure 4:
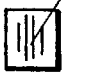

At the end face 22 of the connector 3 a continuous groove 31 is provided into which the dry (solid) member 32 (FIGS. 2–4) is inserted. The sealing member 32 is comprised advantageously of silicone, but may also be comprised of polytetrafluoroethylene, polyethylene , rubber etc. The dry sealing member 32 to be inserted before attachment of the profiled beams 1 to the connecting member 2 into the groove 31 is matched in its shape to the shape of the end face 22 of the respective connectors 3–6. The sealing member 32 embodied as a shaped part has accordingly two parallel extending legs 33, 34 at its proposed ends which are connected by connecting pieces 35, 36 extending perpendicularly to the legs to inner legs 37 and 38. They extend parallel to one another and to the outer legs 33, 34 and are connected at their other ends by a transverse stay 39 (FIG. 2). The outer legs 33, 34, when mounted, rest in the groove sections correlated with sidewalls 8, 9 of the connecting member 2. The inner legs 37, 38 are positioned in the groove sections provided within the sidewalls 12, 13 of the connecting member 2 while the transverse stay 39 is inserted into the groove section provided at the cover wall 16. The bottom 14 of the connectors 3–6 is not provided with a groove section.

The dry sealing member 32 can be inserted, before assembly of the profiled beams 1, easily into the groove 31 at the end faces of the connectors 3–6 of the connecting member 2. It is then easily possible to check whether the sealing member is properly inserted. The grooves 31 at the end faces 22 of the connectors 3–6 are of such a depth that the dry sealing members 32 are safely and securely held in the grooves. This ensures that the sealing members 32 during assembly of the profiled beams 1 will not fall out of the groove or cannot be displaced within the groove 31. The sealing members 32 project slightly from the grooves 31 so that during attachment of the profiled beams 1 by threading they are elastically compressed because the profiled elements 25 of the profiled beams 1 have the same cross-sectional contour as the connectors 3–6. In this manner a proper and reliable sealing at the abutment area between the profiled beams 1 and the connectors 3–6 is possible. The use of dry sealing members 32 has the advantage that they can be reused so that, after repairs at the ceiling arrangement, the dry sealing members can be again reinserted. Furthermore, dry sealing members 32 are inexpensive.

The sealing member 32 has a rectangular cross-section with preferably rounded edges. This facilitates insertion of the sealing member 32 into the groove 31.

The groove 31 can also be provided at the end face of the profiled element 25 of the respective profiled beam 1. It is also possible to provide in the end faces of the connectors 3 and of the profiled element 25 a respective groove for the sealing member 32. It is then of such a thickness that it is elastically compressed in the mounted position in order to ensure the proper sealing action in the abutment area.

The specification incorporates by reference the disclosure of German priority document 198 03 080.0 of Jan. 28, 1998.

The present invention is, of course, in no way restricted to the specific disclosure of the specification and drawings, but also encompasses any modifications within the scope of the appended claims.

What is claimed is:

1. A ceiling arrangement for clean rooms, said ceiling arrangement comprising:

profiled beams (1) having end faces;

connecting members (2) having at least two end faces that are connectors (3, 4, 5, 6) for said end faces of said profiled beams (1);

wherein said end faces of said profiled beams (1) are connected to said connectors of said connecting members (2) to form a flush connection;

a sealing member (32) for sealing each one of said flush connections wherein a respective sealing member (32) is insertable into each connector (3, 4, 5, 6);

wherein for each one of said flush connections said end face of said connecting member (2) or said end face of said profiled beam (1) has a groove (31) in which said sealing member (32) is received.

2. A ceiling arrangement according to claim 1, wherein said groove (31) is provided at said end face of said connecting member (2).

3. A ceiling arrangement according to claim 2, wherein said groove (31) extends across the entire width of said end face of said connecting member (2).

4. A ceiling arrangement according to claim 2, wherein said profiled beams (1) have a profiled element (25) matching a shape of said groove (31).

5. A ceiling arrangement according to claim 2, wherein said groove (31) is provided in two parallel sidewalls (8, 9) of said end face of said connecting member (2).

6. A ceiling arrangement according to claim 2, wherein said groove (31) is provided in two parallel inner walls (12, 13) of said end face of said connecting member (2).

7. A ceiling arrangement according to claim 1, wherein said end face of said connecting member (2) has two parallel sidewalls (8, 9) and two parallel inner walls (12, 13), positioned inwardly relative to said sidewalls (8, 9), and further has connecting walls (10, 11, 16) connecting said inner walls to said sidewalls, respectively, wherein said groove (31) is provided in said connecting walls (10, 11, 16).

8. A ceiling arrangement according to claim 1, wherein said connectors of said connecting members (2) are profiled pieces.

9. A ceiling arrangement according to claim 1, wherein said sealing member (32) has a thickness that is greater than a depth of said groove (31).

10. A ceiling arrangement according to claim 1, wherein said sealing member (32) has rounded edges.

11. A ceiling arrangement according to claim 1, wherein said sealing member (32) is a shaped part.

12. A ceiling arrangement according to claim 1, wherein said sealing member (32) consists of plastic material.

13. A ceiling arrangement according to claim 1, wherein said sealing member (32) consists of silicone.

14. A ceiling arrangement according to claim 1, wherein said sealing member (32) consists of rubber.

15. A ceiling arrangement for clean rooms, said ceiling arrangement comprising:

profiled beams (1) having end faces;

connecting members (2) having at least two end faces that are connectors (3, 4, 5, 6) for said end faces of said profiled beams (1), wherein said end faces of said profiled beams (1) are connected to said connectors of said connecting members (2) to form a flush connection;

a sealing member (32) for sealing each one of said flush connections, for each one of said flush connections said end face of said connecting member (2) or said end face of said profiled beam (1) has a groove (31) in which said sealing member (32) is received, wherein said end face of said connecting member (2) has two parallel sidewalls (8, 9) and two parallel inner walls (12, 13) positioned inwardly relative to said sidewalls (8, 9), and further has connecting walls (10, 11, 16) connecting said inner walls to said sidewalls, respectively, wherein said groove (31) is provided in said connecting walls (10, 11, 16).

* * * * *